US005318786A

United States Patent [19]

Clarkson

[11] Patent Number: 5,318,786

[45] Date of Patent: Jun. 7, 1994

[54] SUSPENDED BEVERAGE INFUSION BAG

[76] Inventor: Melvin Clarkson, 7810 Savannah Ct., Boise, Id. 83703

[21] Appl. No.: 116,060

[22] Filed: Sep. 2, 1993

Related U.S. Application Data

[63] Continuation-in-part of Ser. No. 940,063, Sep. 3, 1992, abandoned.

[51] Int. Cl.[5] ..... B65B 29/04; B65D 30/02; B65D 30/22; B65D 33/06

[52] U.S. Cl. ..... 426/79; 426/82

[58] Field of Search ..... 426/77-84, 426/112, 433, 435

[56] References Cited

U.S. PATENT DOCUMENTS

| | | | |
|---|---|---|---|
| 2,192,605 | 3/1940 | Salfisberg | 426/82 |
| 2,698,082 | 12/1954 | Maloney | 426/77 |
| 2,728,671 | 12/1955 | Young | 426/82 |
| 2,793,120 | 5/1957 | Bennett | 426/79 |
| 2,800,408 | 7/1957 | Fimple | 426/80 |
| 3,387,978 | 6/1968 | Major | 426/80 |
| 3,895,118 | 7/1975 | Rambold | 426/83 |
| 3,899,599 | 8/1975 | Rambold | 426/82 |
| 4,141,997 | 2/1979 | Syroka et al. | 426/79 |
| 4,250,990 | 2/1981 | Casper | 426/80 |
| 4,584,101 | 4/1986 | Kataoka | 210/474 |
| 4,688,479 | 8/1987 | Cunningham | 426/80 |
| 4,715,271 | 12/1987 | Kitagawa | 426/82 |
| 4,726,956 | 2/1988 | Christie | 426/80 |
| 4,844,914 | 7/1989 | Bonne et al. | 426/80 |
| 4,871,555 | 10/1989 | Schwartz et al. | 426/82 |
| 4,948,601 | 8/1990 | Serbu | 426/82 |
| 5,059,325 | 10/1991 | Iida | 426/82 |
| 5,132,124 | 7/1992 | Tamaki | 426/112 |

FOREIGN PATENT DOCUMENTS

| | | | |
|---|---|---|---|
| 203165 | 5/1959 | Australia | 426/77 |
| 50-39822 | 11/1975 | Japan | 426/82 |
| 63-95528 | 6/1988 | Japan | 426/82 |
| WO91103 | 9/1991 | PCT Int'l Appl. . | |
| 563756 | 7/1975 | Switzerland | 426/82 |
| 2229991 | 10/1990 | United Kingdom | 426/77 |

OTHER PUBLICATIONS

Tea & Coffee Trade J. Jan. 1953 pp. 39, 41.

*Primary Examiner*—Steven Weinstein

*Attorney, Agent, or Firm*—Frank J. Dykas; Craig M. Korfanta

[57] ABSTRACT

A suspended beverage infusion bag (10, 20) is disclosed. The bag has a cover (13, 23) which is two generally planar leaves (12, 22) separated by a fold line (14, 24). The fold line (14, 24) may be vertical or horizontal, depending on the style of the infusion bag. Both of the cover leaves (12, 22) have a downwardly-facing slot (11, 21) which fits over and fastens the cover (13, 23) to the rim (1) of a beverage cup (2), thereby holding the leaves (12, 22) in spaced-apart relationship on the cup rim (1). A porous filter bag (15, 25) is attached to the cover (13, 23); either along one of the filter bag's side surfaces (17, 27), or along its top edge, by a single glue line (31) on one side surface (18, 30) of a planar leave (12, 22). When one filter bag (15, 25)is used, it is attached to the cover (13, 23) near the fold line (14, 24). When two filter bags (15, 25) are used, they are attached to the cover near the side or bottom edges of the two leaves (12, 22). This way, the filter bag (15, 25) is suspended near the center inside of the cup (2), away from the cup side walls (5) and easily available for contact on all sides with the water (3) in the cup.

1 Claim, 7 Drawing Sheets

SUSPENDED BEVERAGE INFUSION BAG

This application is a continuation-in-part of my prior, copending application, Ser. No. 07/940,063, filed 3 Sep. 1992, now abandoned, and entitled SUSPENDED BEVERAGE INFUSION BAG, the disclosure of which is hereby incorporated by reference thereto.

BACKGROUND OF THE INVENTION

1. Technical Field

This invention relates generally to means for preparing beverages. More particularly, it relates to infusion bags for preparing coffee and tea, which bags may be conveniently supported by the rim of a cup, and suspended therein.

2. Background Art

U.S. Pat. No. 3,895,118, Rambold, discloses a beverage infusion filter bag stapled to a folded strip of non-porous sheet material. The folded strip has two side portions on opposite sides of the filter bag which may be folded back upon themselves and secured together by complimentary slits in the side portions.

U.S. Pat. No. 4,141,997, Syroka et al., discloses a beverage infusion bag free of direct attachments which is clipped to the rim and side wall of a cup by an arched clip.

U.S. Pat. No. 4,584,101, Kataoka, discloses a beverage filter assembly with a generally rectangular support plate having an intermediate portion and a pair of support legs connected to opposite ends of the intermediate portion. The support legs have feet such that, when the support legs are folded vertically downward relative to the intermediate portion, the feet are engageable with the upper edge of a beverage container for supporting the whole assembly in a raised position above the container for use as a filter.

U.S. Pat. No. 4,726,956, Christie, discloses a tea bag with a 2-leave cover. The bag is stapled to one leaf below the fold line so that leaf will support the bag on the rim of the cup with a wedging action. The other leaf is folded back away from the bag which is cantilevered within the cup and exposed for contact with the water poured into the cup.

U.S. Pat. No. 4,871,555, Schwartz, et al., discloses an infusion device comprising a porous bag with a stirring and hanging unit partially located within the bag, and partially protruding from the bag. The stirring and hanging unit is rigid or partially rigid.

U.S. Pat. No. 4,948,601, Serbu, discloses a coffee brewing device which comprises an elongated filter bag attached at one of its side edges to a bag support element which hooks over the rim of a cup at the element's top end. At the element's bottom end is an unattached carved portion which fits down into and rests on the bottom of the cup and which supports the top of the filter bag above the rim of the cup.

Japanese Examined Utility Model Publication No. 50-39822, Mori, and PCT Publication No. WO 91/10390, Kaisha, disclose beverage filter bags with a reinforcing paper layer superimposed on the outside upper portion of the bags. The reinforcing paper has cut-out tabs which act as supporting members when folded out away from the filter bags for engaging with the upper edge of a beverage container for suspending the bags within the beverage container.

So, there have been attempts in the beverage infusion art to provide a convenient and effective filter bag for preparing coffee and tea. Also, there have been attempts in the art to provide a bag which is securely fastened to the rim of the cup for contact with the water poured into the cup, and which is efficiently suspended inside the cup away from the cup side walls for maximum contact on all sides with the water in the cup. Also, there have been attempts to provide such an infusion bag in an inexpensive and easily manufactured package. Many of these attempts, however, have not been commercially successful.

DISCLOSURE OF INVENTION

I have invented a convenient and efficient suspended beverage infusion bag. My bag is easily and securely fastened to the rim of a cup by a downwardly-facing slot in two generally planar leaves of a cover separated by a fold line. The fold line may be vertical or horizontal, depending on the embodiment of my invention. A porous filter bag is attached to the cover, either along a side edge of the filter bag, or along its top edge, by a single glue line on one side surface of a planar leave. The bag may be attached to a leave of the cover near the fold line of the cover when one bag is used. When two bags are used, the bags may be attached to the cover near the side or bottom edges of both of the two leaves. When the slots in the leaves of the cover are hooked over the rim of a cup and maintained in spaced apart relationship, the porous filter bag is suspended near the center inside of the cup, away from the cup side walls and easily available for contact on all sides with the water in the cup. In a preferred embodiment, the infusion bags and covers are manufactured in a strip of separable units for convenient packaging.

BEST MODE FOR CARRYING OUT INVENTION

Figure 1:
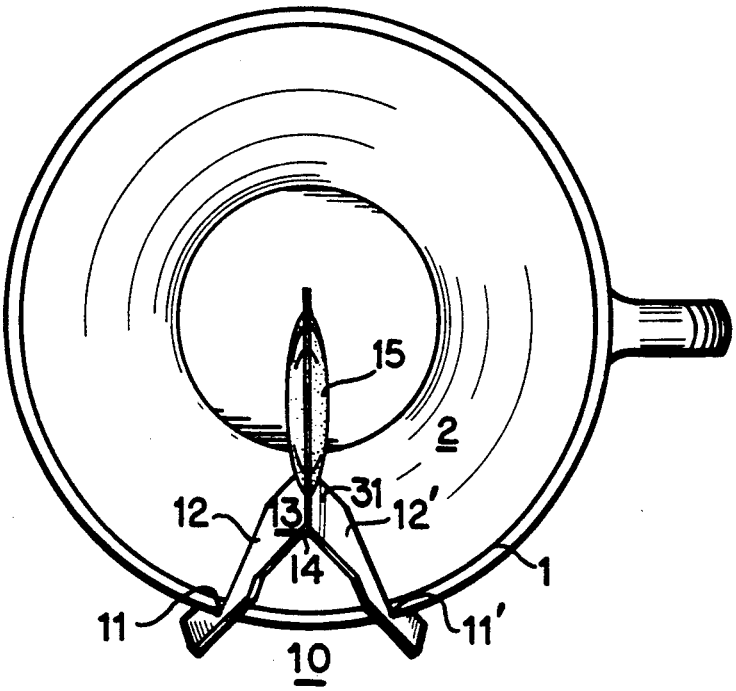
FIG. 1 is a top perspective view of a single-bag embodiment of my infusion package on a cup rim.
Figure 2:
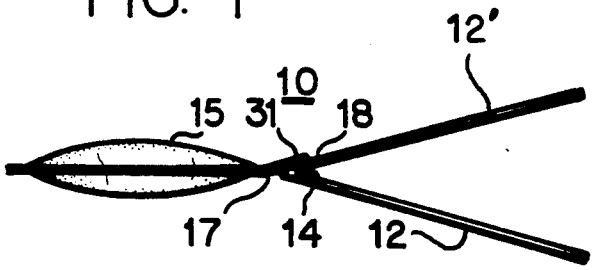
FIG. 2 is a top view of the package from FIG. 1, but without the cup.
Figure 3:
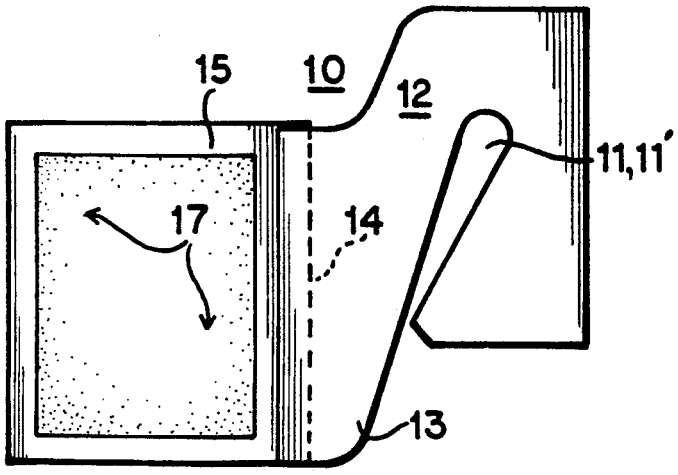
FIG. 3 is a side view of the package from FIG. 2.

Referring to the Figures, there is depicted generally in FIGS. 1–3 a single bag embodiment of my infusion bag package 10. Package 10 is fastened to the rim 1 of cup 2 by downwardly-facing slots 11 and 11' in two generally planar leaves 12 and 12' of cover 13. Leaves 12 and 12' are separated by vertical fold line 14 in cover 13. A porous filter bag 15, partially filled with infusible substance 16, like coffee or tea, is attached to cover 13 along a side surface 17 of bag 15 at side surface 18 of cover 13.

When slots 11 and 11' in leaves 12 and 12', respectively, are hooked over and fastened to rim 1 of cup 2, leaves 12 and 12' may be securely held in spaced-apart relationship. This way, porous filter bag 15 is suspended near the center inside of cup 2, away from the cup sidewalls and easily available for contact on all sides with the water in the cup.

Figure 4:
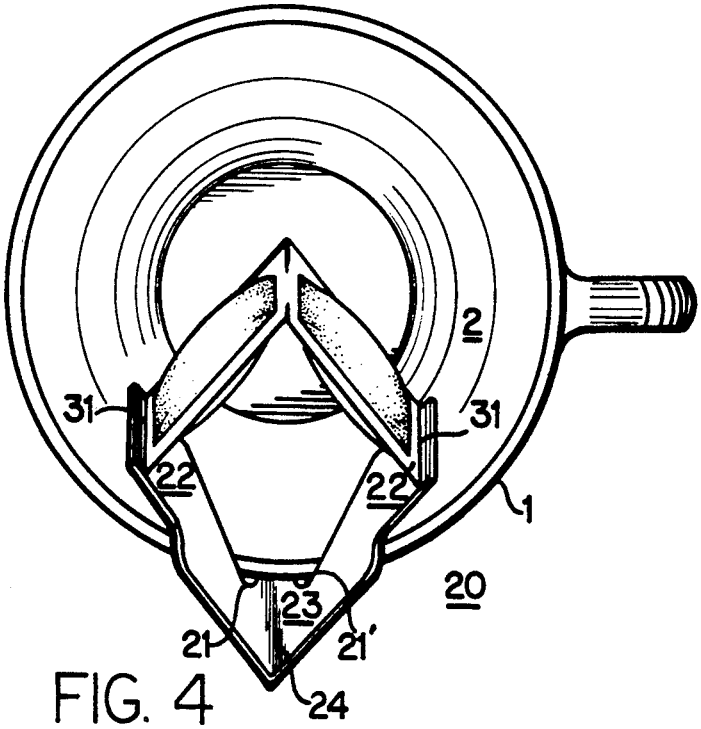
FIG. 4 is a top perspective view of a double-bag embodiment of my infusion package on a cup rim.
Figure 5:
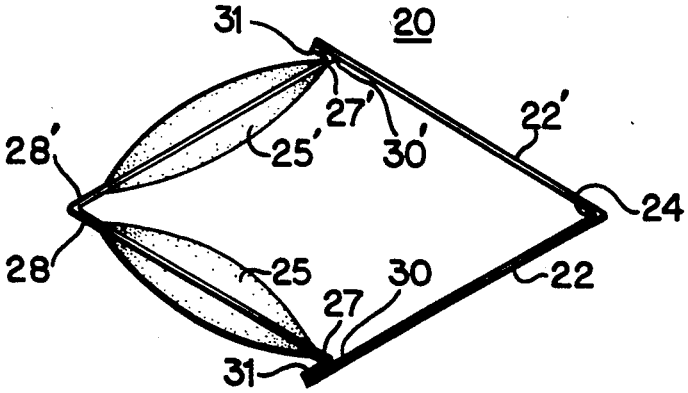
FIG. 5 is a top view of the package from FIG. 4, but without the cup.
Figure 6:
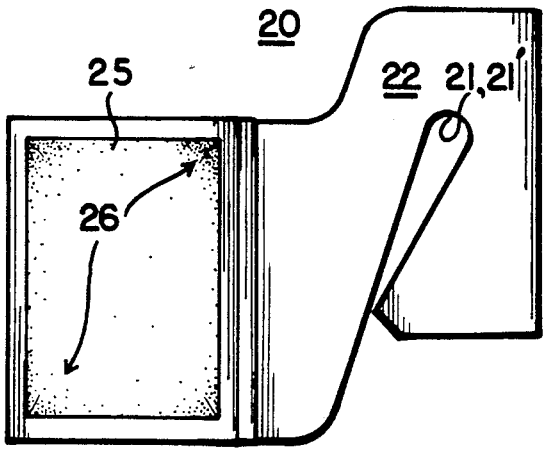
FIG. 6 is a side view of the package from FIG. 5.

In FIGS. 4–6 there is depicted generally a double-bag embodiment of my infusion bag package 20. Package 20 is fastened to the rim 1 of cup 2 by downwardly-facing slots 21 and 21' in two generally planar leaves 22 and 22' of cover 23. Leaves 22 and 22' are separated by vertical fold line 24 in cover 23. A pair of porous filter bags 25 and 25', partially filled in infusible substance 26, like coffee or tea, is attached to cover 23 along side surfaces 27 and 27' of bags 25 and 25' at side surfaces 30 and 30' of cover 23, respectively. In turn, filter bags 25 and 25' are joined together along their common side edges 28 and 28', respectively.

When slots 21 and 21' in leaves 22 and 22', respectively, are hooked over and fastened to rim 1 of cup 2, leaves 22 and 22' may be securely held in spaced-apart relationship. This way, porous filter bags 25 and 25' are suspended near the center inside of cup 2, away from the cup sidewalls and easily available for contact on all sides with the water in the cup.

Figure 7:
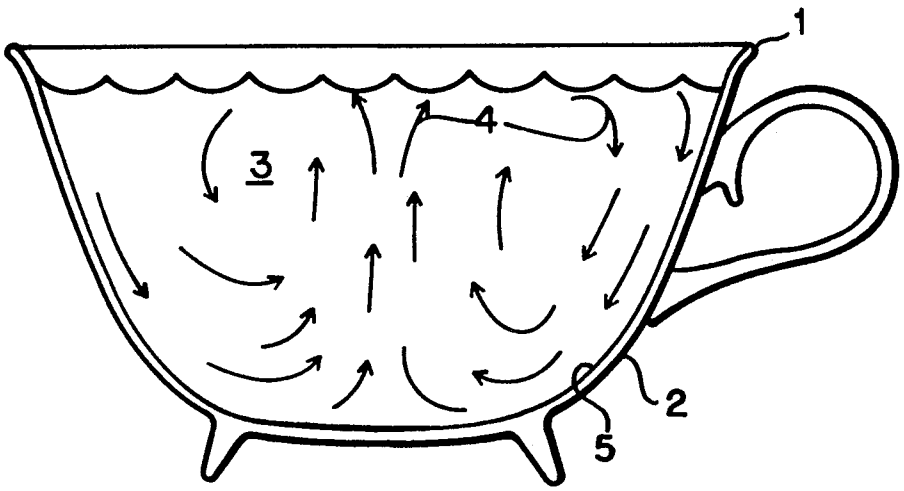
FIG. 7 is a side, cross-sectional view of a cup of hot water showing by arrows the ordinary thermal currents in the cup.

In FIG. 7 there is depicted cup 2 with rim 1, sidewall 5 and water 3 in cup 2. When water 3 is hot, or being heated without agitation, as in a microwave oven, for example, ordinary thermal currents depicted by arrows 4 develop in the cup. The water tends to cool at the outside walls of the cup and at the water's top surface, so the currents tend to be down at these locations. The water remains hottest at the center and bottom of the cup, so the currents tend to be up at these locations.

Figure 8:
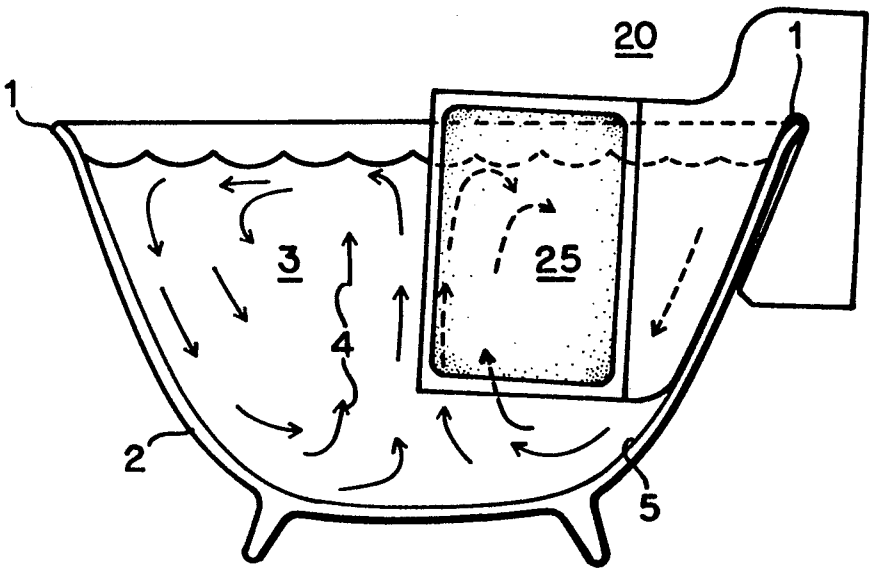
FIG. 8 is the view of FIG. 7 with an embodiment of my infusion package on the cup rim.

In FIG. 8 there is depicted cup 2 with rim 1, water 3, water thermal currents 4, and sidewall 5 in the cup 2. As may be seen from the Figure, when my infusion package 20 is hooked on rim 1, filter bag 25 is suspended near the center inside of cup 2, away from the sidewall 5 and easily available for contact on all sides with water 3 in cup 2. Also, it may be seen from the Figure that bag 25 is available for contact with water thermal currents 4 flowing in all directions, providing efficient contacting between the water 3 and the infusible substance 26 inside filter bag 25.

Figure 9A:
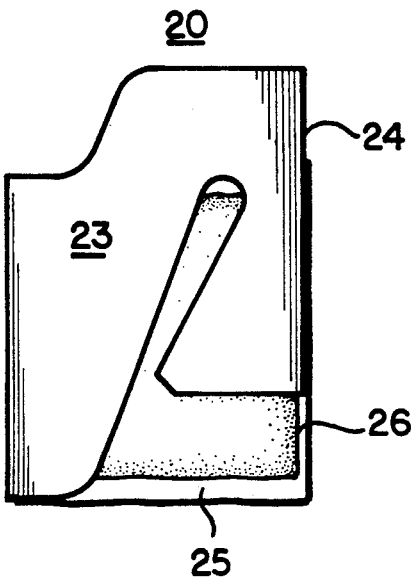
FIG. 9A is an embodiment of my double-bag infusion package folded up prior to use.
Figure 9B:
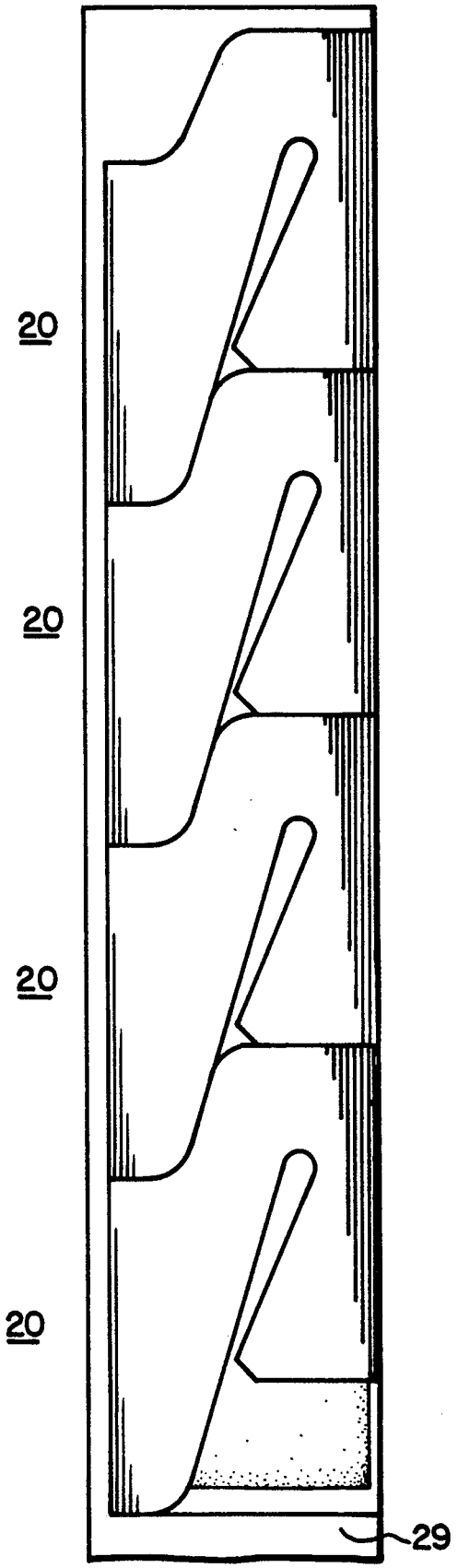
FIG. 9B is an embodiment of the package from FIG. 9A manufactured in a strip of separable units for convenient packaging.

In FIG. 9A there is depicted an embodiment of my double-bag infusion package 20 folded up prior to use. In FIG. 9B there is depicted an embodiment of four (4) of my double-bag infusion packages 20 manufactured together in a strip, and packaged together in plastic wrap envelope 29. This embodiment of my invention lends itself to economical and convenient manufacturing and packaging.

My infusion package may be made from conventional materials by conventional techniques for food packaging. I prefer plastic coated paper for the cover, and plastic coated net-weave fabric for the filter bag. The plastic coating must not degrade at or less than 212° F., the boiling temperature of water, and must not impart any taste to the beverage in the cup. Preferably, the melting characteristics of the plastic coatings are used to attach the filter bag to the cover by fusing the plastic coatings between them with a hot roller.

In the beverage infusion bag industry, the fusing discussed above of the plastic coatings on the bag and the cover is called a "melt" or a "glue". When the "melt" or "glue" is done with a small enough hot roller or wheel, the resulting thin fused connection is called a "melt line" or a "glue line". Thinner "glue lines" are preferred because they require less energy and space to make them.

Also, preferably, the "glue lines" are in a straight direction. This way, they may be conveniently made in assembly-line fashion by the moving infusion package passing by the stationary hot roller or wheel. The "glue lines" may be continuous or intermittent, and they may be made with or without added adhesive material. By "line" I mean a figure whose length is many times longer than its width, including a set of dashes in one general direction.

One feature of my invention is that the bag need not be stapled to the cover, which eliminates the staple and the stapling step from my manufacturing process. Another feature of my invention is that the bag may be connected to the cover with just one "glue line", which further simplifies the manufacturing process. For my invention no large area connection of the bag to the cover need be made, as is required in both the Mori and Kaisha references discussed above. By "area" I mean a figure whose length and width are of the same order of magnitude.

Figure 10A:
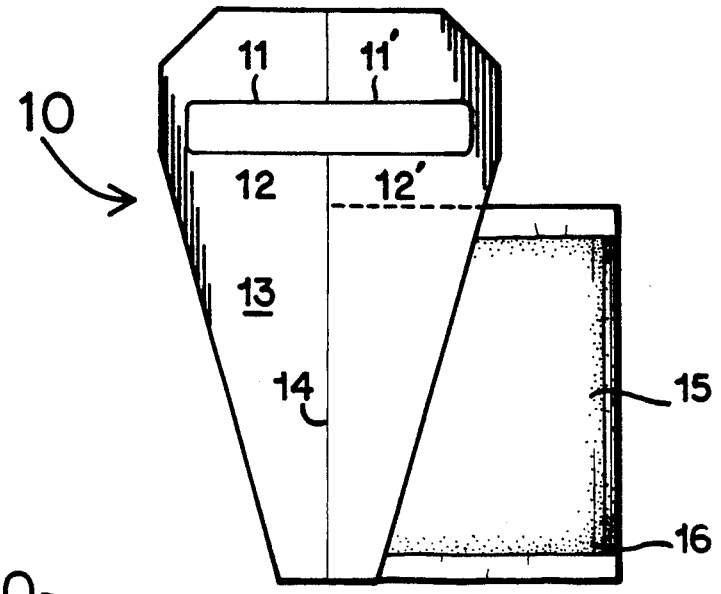
FIGS. 10A, B and C are different embodiments of my infusion package wherein the filter bag is attached to the cover leaves at the bag's top edge.
Figure 10B:
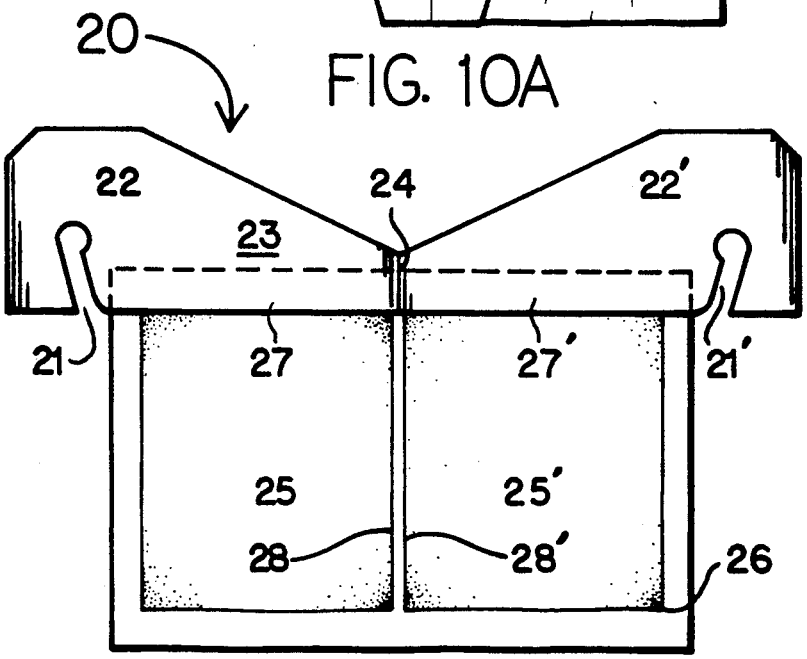
Figure 10C:
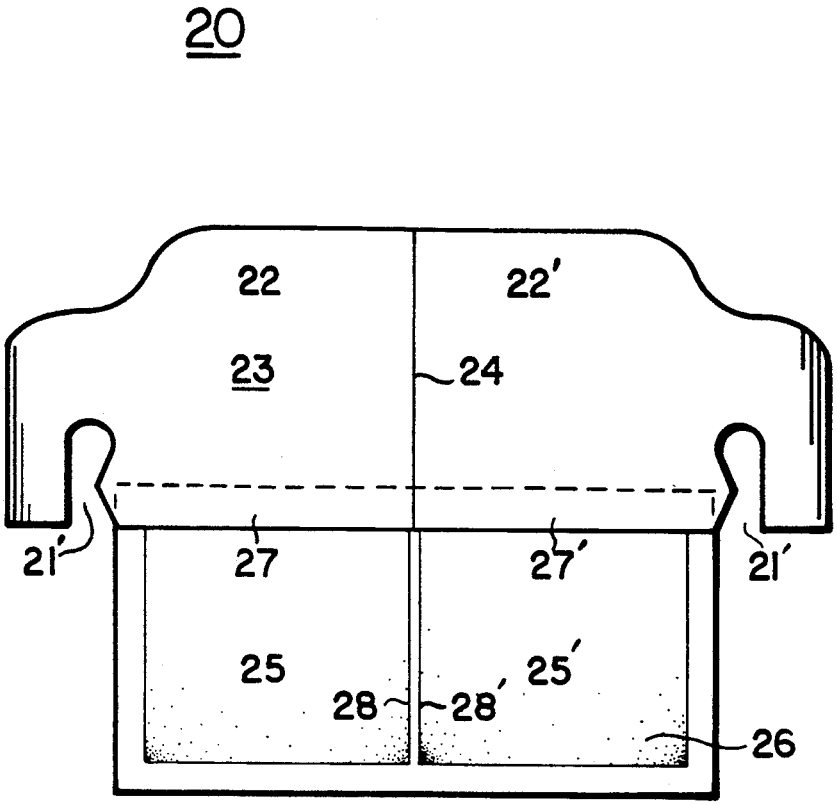

Additional different embodiments of my invention, like those embodiments depicted in FIGS. 10A, B and C, are contemplated. For example, the leaves of my cover may be thinner, longer arms which extend out into the inside of the cup, and from which the filter bag hangs down into near the center of the cup. In this embodiment, the filter bag, in either the single-bag or double-bag version, will be attached to the cover leaves at its top edge. Presently, my preferred embodiment is that depicted in FIG. 10C.

Figure 11:
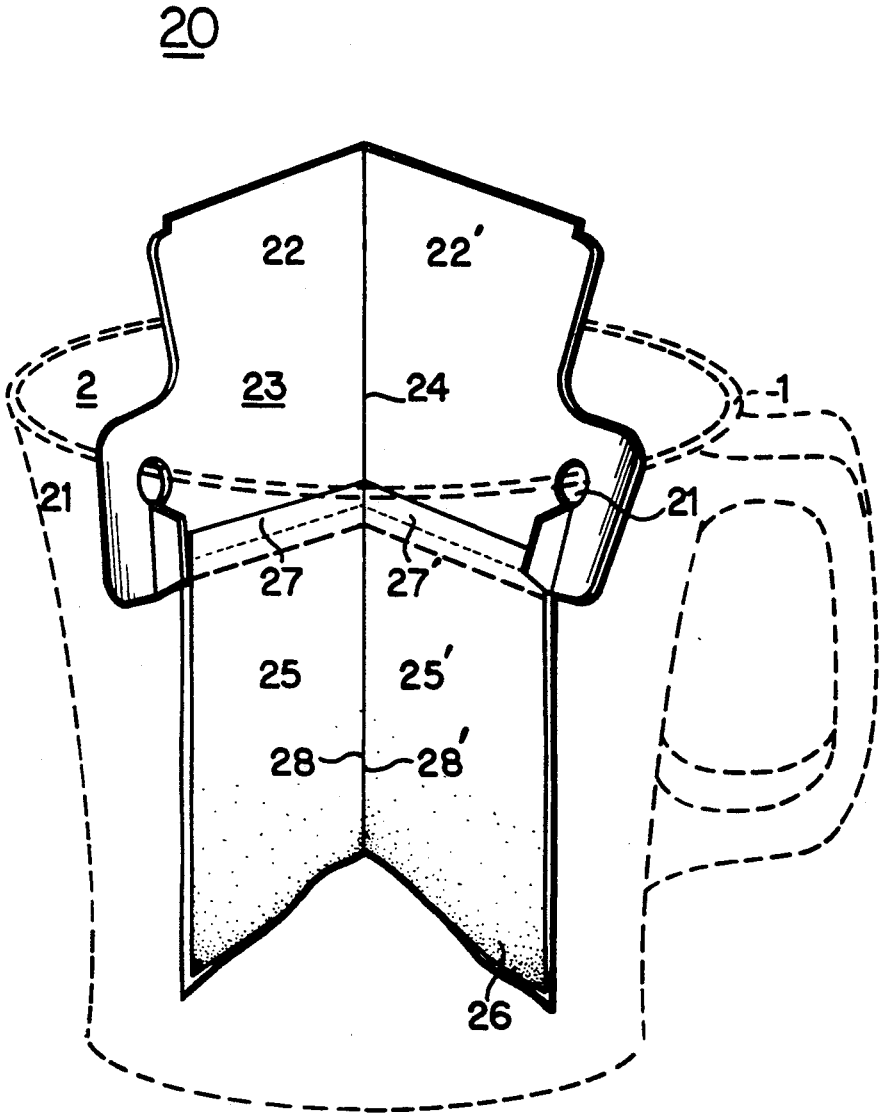
FIG. 11 is a top perspective view of my preferred embodiment, a version of the double-bag package depicted in FIG. 10C.

Slots 11, 11', 21 and 21' may be narrow cuts, including slits, in leaves 12, 12', 22 and 22', respectively. Or, they each may be a combination of a slot, or notch, and slit. Furthermore, the leaves may be scored or creased in the region of the slot to provide reinforcing flanges when folded at the scored region for placement against the outer sidewall of the cup near its rim, as depicted in FIG. 11. Also, the ends of the slots in the leaves may terminate in round holes or other reinforcing means to prevent tearing of the leave at the termination of the slot, as depicted in FIG. 11.

To use my infusion package, one simply unwraps it, unfolds it, hooks the slots in the cover leaves over the rim of a cup with the leaves spaced apart, and adds water to the cup. The added water may be hot, or it may be room temperature, with the cup and the water in it being heated together in a microwave oven, for example. When the beverage has been prepared, the infusion package may be easily removed and safely discarded by grasping the dry, cool portions of the cover leaves.

While there is shown and described the present preferred embodiment of the invention, it is to be distinctly understood that this invention is not limited thereto but may be variously embodied to practice within the scope of the following claims.

I claim:

1. A beverage infusion device for infusing a beverage in a cup, said infusion device consisting of:

a pair of sealed water permeable filter bags and a cover; wherein each bag contains an infusible substance for making a beverage; said filter bags being joined together along a common vertically oriented side edge so that the bags are capable of being folded toward each other along said common side edge; said bags further having a horizontally oriented top edge and bottom edge transverse to said common side edge; said vertical and horizontal orientation being relative to said bags when said bags are positioned substantially vertically upright on said bottom edge; said cover consisting of two generally planar leaves having side surfaces and top and bottom edges, and being joined together by a common vertically oriented fold line relative to said leaves when positioned upright on said bottom edge; each of said leaves having a single slot that is oriented substantially vertically and that opens downwardly at said bottom edge of said leaves relative to the top edge of said leaves; said pair of filter bags being connected to said cover by a single horizontally oriented glue line that secures said filter bags to said cover sheet only between the horizontally oriented top edge of said bags and the common side surface of said planar leaves adjacent said bottom edges of said leaves such that each bag is secured to a respective one of said leaves and said common fold line of said leaves is in substantial alignment with said common side edge of said bags;

said bags, leaves, and slots being dimensioned and configured such that when said leaves are folded along said common fold line back toward each other and said common fold line extends out over the cup near its center, sufficient for said slots to be hooked down and fastened onto the rim of said cup, said leaves are held securely in spaced apart relationship on said cup and said filter bags secured to said leaves will in turn also be folded back toward each other such that said filter bags will be suspended in the cup substantially vertically upright and substantially away from the side walls of said cup, with said common side edge suspended near the center of said cup and with at least substantially all of said filter bags being below the rim of the cup such that the filter bags are readily available for contact on all sides with water placed in the cup.

* * * * *